US012774823B2

(12) United States Patent
Beauvais

(10) Patent No.: US 12,774,823 B2
(45) Date of Patent: Oct. 27, 2026

(54) ROOF VENT COVER

(71) Applicant: Pierre Beauvais, Victoria (CA)

(72) Inventor: Pierre Beauvais, Victoria (CA)

( * ) Notice: Subject to any disclaimer, the term of this patent is extended or adjusted under 35 U.S.C. 154(b) by 376 days.

(21) Appl. No.: 18/539,652

(22) Filed: Dec. 14, 2023

(65) Prior Publication Data

US 2024/0110713 A1 Apr. 4, 2024

Related U.S. Application Data

(63) Continuation-in-part of application No. 17/319,518, filed on May 13, 2021, now Pat. No. 12,205,008.

(51) Int. Cl.
*F24F 7/02* (2006.01)
*F24F 13/20* (2006.01)

(52) U.S. Cl.
CPC ..... *F24F 7/02* (2013.01); *F24F 13/20* (2013.01)

(58) Field of Classification Search
CPC ..... F24F 7/02; F24F 13/20
See application file for complete search history.

(56) References Cited

U.S. PATENT DOCUMENTS

| | | | | |
|---|---|---|---|---|
| 3,520,245 | A * | 7/1970 | Painter | F24F 7/02 52/302.1 |
| 2005/0005541 | A1* | 1/2005 | West | E04D 13/17 52/198 |
| 2005/0215192 | A1* | 9/2005 | Rye | E04D 13/178 52/95 |
| 2007/0173191 | A1* | 7/2007 | Daniels, II | F24F 7/02 454/250 |

* cited by examiner

*Primary Examiner* — Allen R. B. Schult
(74) *Attorney, Agent, or Firm* — David W Barman

(57) ABSTRACT

A roof vent top cover that is configured to be removably attached on an existing roof vent base plate system of a building wherein the roof vent top cover is transparent or translucent and inhibit the building of wasps nests and the like through creation of an undesirable environment.

5 Claims, 3 Drawing Sheets

ROOF VENT COVER

CROSS-REFERENCE TO RELATED APPLICATIONS

This application is a continuation in part of U.S. patent application Ser. No. 17/319,158 filed May 13, 2021, the disclosure of which is incorporated herein by reference in its entirety.

BACKGROUND OF THE INVENTION

The present invention relates generally to structure building elements, more specifically but not by way of limitation, to roof and sidewall vent covers for exhaust fan outlets, heat exchange outlets and the like that propagate through the roof and sidewall wherein the present invention is constructed to inhibit wasps and similar insect from building a nest therein. Furthermore, the advantage of the present invention provides improved inspection techniques.

Millions of buildings such as but not limited to single family residences and multi-family dwellings employ various vents through the roof. In accordance with most building codes, items such as but not limited to exhaust fans and air exchange outlets are required to be formed in the roofs of structures so as to permit the airflow outward therefrom. These apertures are covered with vent covers in order to inhibit rain and moisture from entering the aperture and potentially causing damage to the structure. The vent covers are typically manufactured from a material such as but not limited to metal or plastic and are comprised of an upper member having a plurality of walls and a connection plate that is sealably secured to the roof.

One issue with existing roof vent covers is the construction thereof provides a desirable environment for insects such as but not limited to wasps. As is known in the art, wasps and similar insects will build nests close to a food source. These insects will build nests utilizing their saliva and regurgitated material and it is desirable for the insect to build these nests in a location wherein the insect feels protected. It is common for these insects to build nest under eaves and other protected areas of a home. Another location that is desirable for a wasp or similar insect to build a nest is underneath the upper cover member of a conventional roof vent. The conventional roof vent offers not only protection from the elements but the construction thereof inhibits light penetration leading to the desired protective environment for which the wasps seek to build their nest.

Accordingly, there is a need for a roof vent cover that is constructed in a manner that provides an environment that is not conducive to the construction of insect nest such as but not limited to wasp nest as the construction of the present invention does not meet a desired criteria for location of a wasp nest.

SUMMARY OF THE INVENTION

It is the object of the present invention to provide a roof or sidewall vent cover that inhibits the construction of a wasp nest or other similar insect nest wherein the present invention includes a body.

Another object of the present invention is to provide an insect inhibiting roof vent cover that prevents the construction of wasp nest and the like therein wherein the body include a base plate member that is sealably secure to a roof around an aperture therein.

A further object of the present invention is to provide a roof or sidewall vent cover that inhibits the construction of a wasp nest or other similar insect nest wherein the body includes at least one wall.

Still another object of the present invention is to provide an insect inhibiting roof vent cover that prevents the construction of wasp nest and the like therein wherein the at least one wall extends upward from the base plate member.

An additional object of the present invention is to provide a roof or sidewall vent cover that inhibits the construction of a wasp nest or other similar insect nest wherein the body further includes an upper cover member suspendedly mounted over the at least one wall.

Yet a further object of the present invention is to provide an insect inhibiting roof vent cover that prevents the construction of wasp nest and the like therein wherein the at least one wall is manufactured from a transparent material.

Another object of the present invention is to provide a roof or sidewall vent cover that inhibits the construction of a wasp nest or other similar insect nest wherein the upper cover member is manufactured from a transparent material.

Still an additional object of the present invention is to provide an insect inhibiting roof vent cover that prevents the construction of wasp nest and the like wherein the at least one wall and the upper cover member are manufactured from a material such as but not limited to Lexan.

A further object of the present invention is to provide a roof or sidewall vent cover that inhibits the construction of a wasp nest or other similar insect nest wherein the present invention can be provided in alternate sizes and shapes.

Still another object of the present invention is to provide an insect inhibiting roof vent cover that prevents the construction of wasp nest and the like wherein the present invention can be configured to cover apertures for exhaust fans, air exchange and other apertures that are formed in the roof of a structure.

In one embodiment, the invention is a roof or sidewall vent top cover portion that is configured to cover a roof or sidewall vent and inhibit development of insect nests being built therein wherein the roof vent cover comprises consisting of:

- a transparent or translucent top cover formed of a single unitary piece constructed and arranged to removably attach to an existing base plate system having base plate member being planar in manner, said base plate member having an upper surface and a mounting plate formed thereon;
- said upper top cover being secured and coupled to said existing base plate system distal to said base plate member, said top cover member configured to inhibit moisture from entering vent;
- wherein said top cover member coupled to said base plate system provides a structure for light to penetrate therethrough, inhibits creation of a dark protected space that will inhibit development of insect nests being built therein.

In one embodiment, the roof or sidewall vent top portion has a unitary body is formed of a clear material having ultraviolet light resistance.

In one embodiment, the roof or sidewall vent top portion unitary body is formed of polycarbonate thermoplastic.

In one embodiment, the roof or sidewall vent top portion unitary body is transparent.

In one embodiment, the roof or sidewall vent top portion unitary body is translucent.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF DRAWINGS

A more complete understanding of the present invention may be had by reference to the following Detailed Description and appended claims when taken in conjunction with the accompanying Drawings wherein:

DETAILED DESCRIPTION OF THE INVENTION

Figure 1:
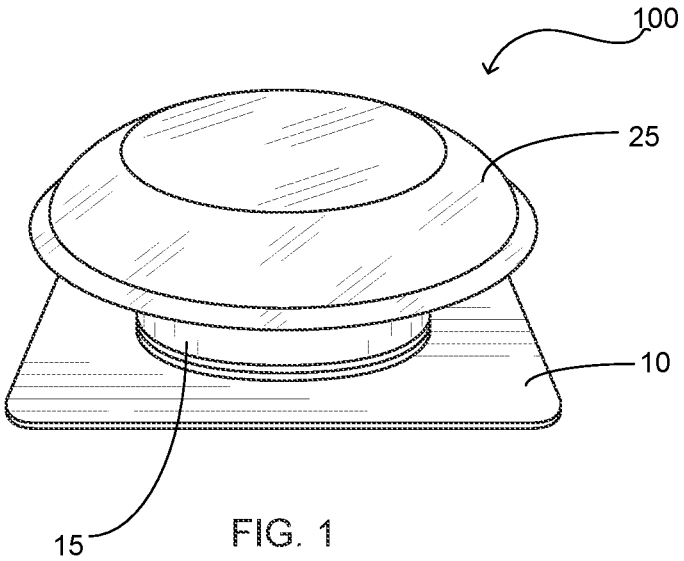
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated a roof vent cover 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures submitted as a part hereof, the roof vent cover 100 includes a base plate member 10. The base plate member 10 is planar in manner and generally square in shape. Base plate member 10 is manufactured from a suitable rigid material such as but not limited to metal. The base plate member 10 is configured to be sealably superposed an aperture in a roof to which the roof vent cover 100 is mounted. The construction of the base plate member 10 facilitates the ability to be place underneath a flashing, shingle or similar structure that is on the roof to which the roof vent cover 100 is secured. The base plate member 10 is secured utilizing suitable sealing compounds and mechanical fasteners. It should be understood within the scope of the present invention that the base plate member 10 could be provided in alternate sizes and shapes.

Figure 2:
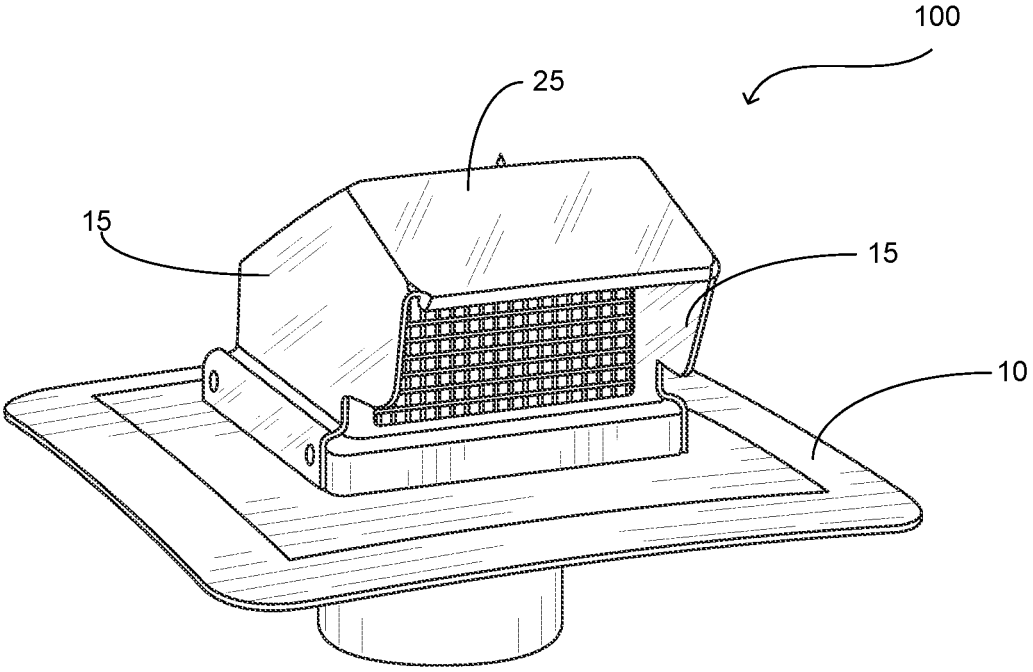
FIG. 2 is a perspective view of an alternative embodiment of the present invention.

Extending upward from the base plate member 10 are wall members 15. Wall members 15 are manufactured from a rigid transparent material such as but not limited to Lexan. The wall members 15 extend upward from the base plate member 10 and are perpendicular thereto. As illustrated in the Figures submitted herewith, the wall members 15 could vary in quantities based on the design of the roof vent cover 100. It should be understood within the scope of the present invention that the roof vent cover 100 could have as few as one wall member 15 formed in an annular shape as illustrated herein in FIG. 1. Alternatively, the roof vent cover 100 could have a plurality of wall members 15 as illustrated herein in the embodiment illustrated in FIG. 2. The transparent characteristic of the wall member 15 allows light to penetrate and as such does not create a dark protected environment sought by insects such as but not limited to wasps. It should be understood within the scope of the present invention that the wall members 15 could be provided in alternate heights.

The roof vent cover 100 further includes an upper cover member 25. The upper cover member 25 is superposed the wall member 15 distal to the base plate member 10. The upper cover member 25 is manufactured from a transparent material such as but not limited to Lexan. The upper cover member 25 is constructed and coupled to the wall member 15 so as to inhibit introduction of rain or other elements into the roof vent cover 100. The transparent construction of the upper cover member 25 provides light to penetrate therethrough which inhibits the creation of a dark protected space in which insects such as but not limited to wasps seek to build nests. As the wall member 15 and upper cover member 25 are manufactured from transparent material this inhibits the building of wasp nests and the like as the desired environment in which to build is inhibited. The transparent material further aids in inspection for blockages and the like. It should be understood within the scope of the present invention that the upper cover member 25 could be constructed in alternate sizes and shapes and further be constructed to either extend outward past the wall member 15 or be secured to the upper edge thereof.

Figure 3:
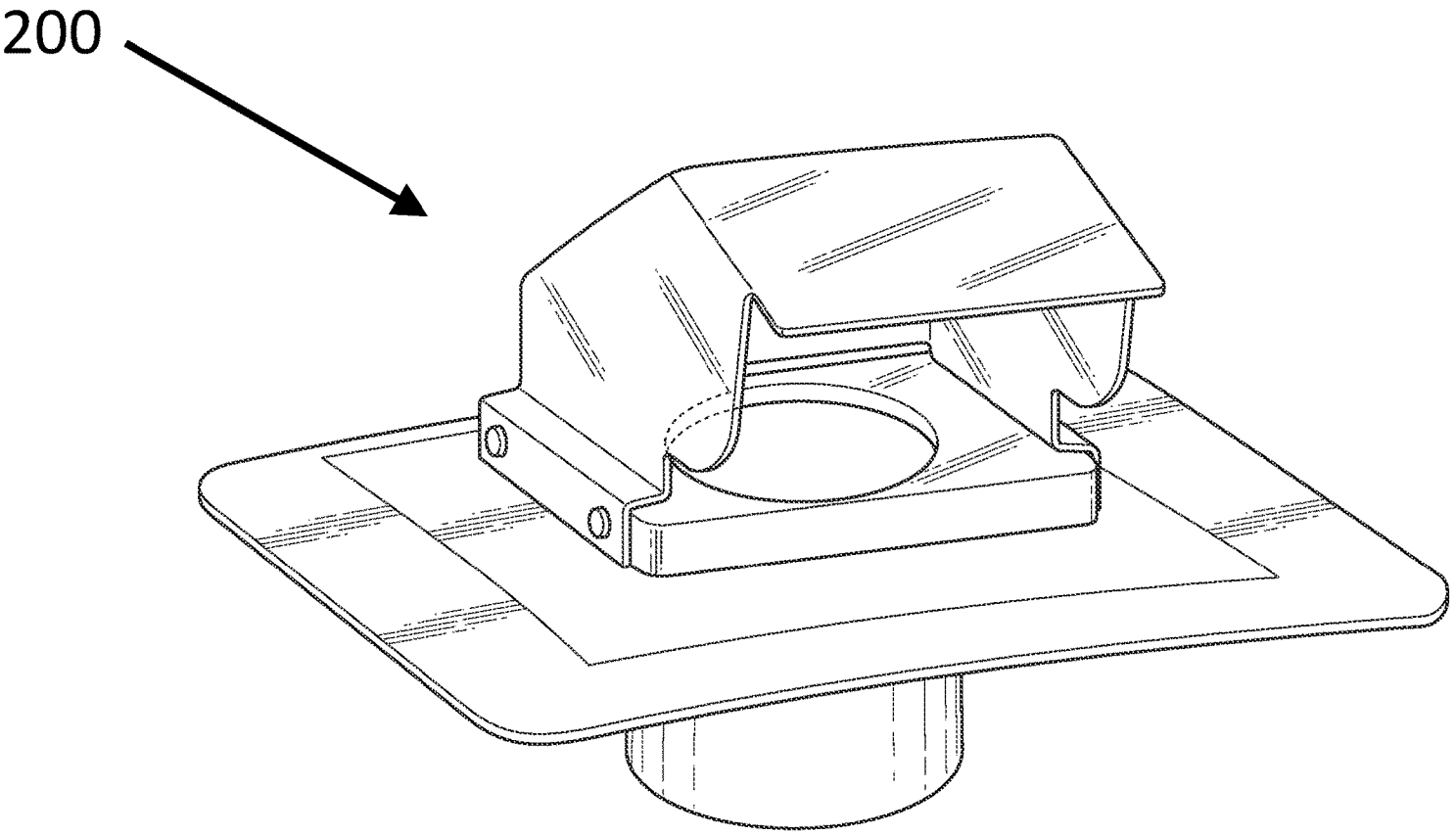
FIG. 3 is a perspective view of an embodiment of the present invention.
Figure 4:
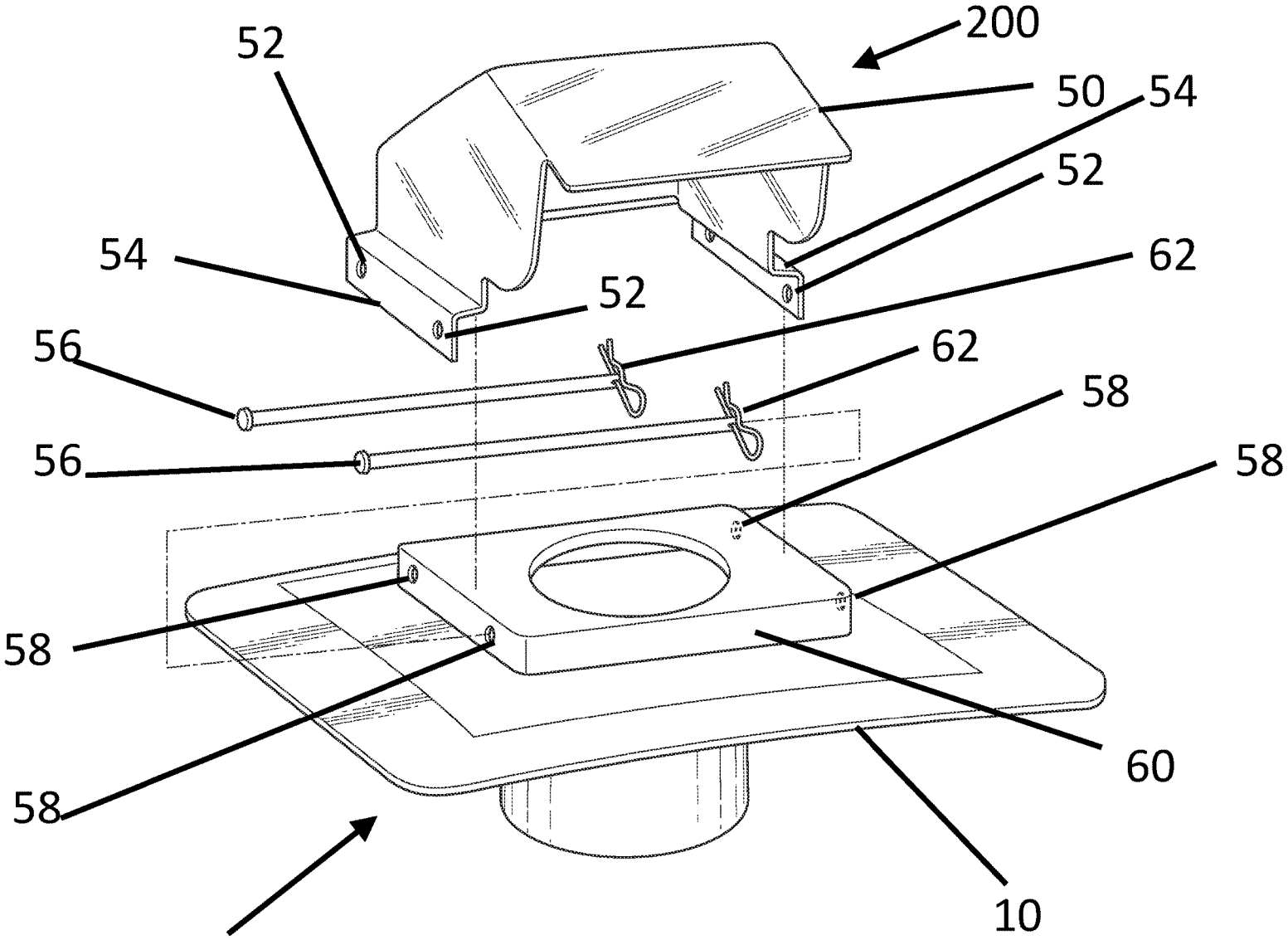
FIG. 4 is a perspective view of separated components of an embodiment of the present invention.

In a preferred embodiment, as depicted in FIGS. 3 and 4, the invention is the top cover and is removable for ease of cleaning as well as transparent for visual inspection of obstructions from a safe distance such as the ground or adjacent window.

System 200 includes vent top cover 50 that is formed of a single unitary transparent or translucent piece and an existing base system 300. In this embodiment, top portion 50 is used on an existing base plate 10 facilitated by an easy to install retrofit kit and onsite drilling/removal of (4) rivets. This is a significant and novel improvement in the field as all current systems require installation of a base plate onto a roof. The present invention is configured such that top portion 50 is secured to an already installed existing base plate 10 and thus eliminates a difficult installation step. In one embodiment, top cover 50 is a single unitary piece molded from UV safe polycarbonate thermoplastic which will not crack or discolor. As mentioned, the transparent top portion 50 will provide clear view remote inspection and help deter wasps from building their nests. Note that my design does not require presence of installation of the pest screen. The clear vent top cover 50 could be purchased as a standalone retrofit kit as stated or included on new roof vents used in the field.

A significant and novel improvement in in the present invention is the configuration to easily remove top cover 50 for cleaning. Thus the present invention is significantly novel in that it is a single unitary piece, clear, and easily removable. There is no current cover that combines these desirous qualities.

The single unitary top cover 50 will cost less to manufacture than all currently known vent covers.

As is known in the industry, base system 300 is installed on a roof and includes a base plate 10, a mounting plate 60 constructed and arranged with access openings 58 configured to receive mounting rods 56 therethrough. Mounting rods 56 are secured into position with locking pins 62. Top cover 50 is positioned on mounting plate 60 such that top plate mounting cavities 52 align and are congruous with access openings 58. Them each mounting rod is passed completely through mounting plate 60 through mounting cavities 52 align and access openings 58. Once each of the mounting rods 56 are completely inserted, locking pins 62 are secured into position in order to secure top portion 50 onto base system 300.

As shown in FIGS. 3 and 4, the system 200 provides top portion 50 that easily is detachable from the base system 300 to accommodate cleaning/clearing of wasp nests while still maintaining a watertight fit.

The transparent configuration of system 200 will act as a deterrent from wasps building their nests as in previously dark areas which is protected from sunlight. Furthermore, the clear design will allow visibility of obstructions from a remote distance such as the ground or adjacent window, making it a safer choice over conventional roof vent hoods. Note that the pest screen is no longer required. (It is in fact useless as it provides wasps a sense of security and the openings are perfectly sized for them to enter)

The invention claimed is:

1. A roof or sidewall vent kit consisting of:

a transparent or translucent top cover formed of a single unitary piece constructed and arranged to removably attach to an existing base plate system having base plate member being planar in manner, said base plate member having an upper surface and a mounting plate formed thereon;

mounting rods constructed and arranged for utilization with locking pins;

locking pins, constructed, and arranged to secure, said, mounting rods;

wherein said mounting plate is constructed and arranged with access openings configured to receive mounting rods therethrough and said mounting rods are constructed and arranged to be completely inserted therethrough and are secured into position with said locking pins.

2. The roof or sidewall vent kit of claim 1 wherein said unitary body is formed of a clear material having ultraviolet light resistance.

3. The roof or sidewall vent kit of claim 1 wherein said unitary body is formed of polycarbonate thermoplastic.

4. The roof or sidewall vent kit of claim 1 wherein said unitary body is transparent.

5. The roof or sidewall vent kit of claim 1 wherein said unitary body is translucent.

* * * * *